US009850871B2

(12) United States Patent
Maragliulo

(10) Patent No.: US 9,850,871 B2
(45) Date of Patent: Dec. 26, 2017

(54) VALVE ASSEMBLY FOR A FLUID INJECTION VALVE AND FLUID INJECTION VALVE

(71) Applicant: Continental Automotive GmbH, Hannover (DE)

(72) Inventor: Marco Maragliulo, San Miniato (IT)

(73) Assignee: CONTINENTAL AUTOMOTIVE GMBH, Hanover (DE)

( * ) Notice: Subject to any disclaimer, the term of this patent is extended or adjusted under 35 U.S.C. 154(b) by 0 days.

(21) Appl. No.: 14/765,329

(22) PCT Filed: Mar. 21, 2014

(86) PCT No.: PCT/EP2014/055691

§ 371 (c)(1),
(2) Date: Aug. 1, 2015

(87) PCT Pub. No.: WO2014/154578

PCT Pub. Date: Oct. 2, 2014

(65) Prior Publication Data

US 2016/0003206 A1 Jan. 7, 2016

(30) Foreign Application Priority Data

Mar. 28, 2013 (EP) ..... 13161691

(51) Int. Cl.
*F02M 63/00* (2006.01)
*F02M 61/18* (2006.01)
(Continued)

(52) U.S. Cl.
CPC .... *F02M 63/0075* (2013.01); *F02M 51/0682* (2013.01); *F02M 51/0685* (2013.01);
(Continued)

(58) Field of Classification Search
CPC ..... F02M 63/00; F02M 63/0033; F02M 61/1833; F02M 61/1846; F02M 63/0075;
(Continued)

(56) References Cited

U.S. PATENT DOCUMENTS 4,593,881 A * 6/1986 Yoshino ..... F25B 41/062 251/124
4,618,092 A * 10/1986 Fukushima ..... B60H 1/3205 236/92 B
(Continued)

FOREIGN PATENT DOCUMENTS

CN 2413041 Y 1/2001 ..... F01M 61/10
DE 3905391 A1 8/1990 ..... F02M 61/06
(Continued)

OTHER PUBLICATIONS

European Search Report, Application No. 13161691.4, 5 pages, dated Aug. 21, 2013.
(Continued)

*Primary Examiner* — Chee-Chong Lee
(74) *Attorney, Agent, or Firm* — Slayden Grubert Beard PLLC

(57) ABSTRACT

A valve assembly for a fluid injection valve has a longitudinal axis and includes a valve seat and a valve disc. The valve seat has an orifice that is laterally offset from the longitudinal axis. The valve disc has a fluid passage which, in a first angular position of the valve disc, is positioned in such fashion that it overlaps the orifice at an interface of the valve disc and the valve seat to establish a fluid path through the valve disc and the valve seat for dispensing fluid from the valve assembly. The valve disc is rotatable around the longitudinal axis with respect to the valve seat from the first angular position to a second angular position, wherein the
(Continued)

valve seat and the valve disc mechanically interact to seal the orifice in the second angular position.

3 Claims, 5 Drawing Sheets

(51) Int. Cl.
*F02M 61/04* (2006.01)
*F02M 51/06* (2006.01)

(52) U.S. Cl.
CPC ..... *F02M 61/042* (2013.01); *F02M 61/18* (2013.01); *F02M 63/0026* (2013.01); *F02M 63/0038* (2013.01); *F02M 63/0077* (2013.01); *F02M 51/0603* (2013.01); *F02M 61/1813* (2013.01); *F02M 61/1833* (2013.01); *F02M 61/1853* (2013.01); *F02M 2200/29* (2013.01)

(58) Field of Classification Search
CPC ..... F02M 51/0682; F02M 51/0685; F02M 61/042; F16K 31/524–31/52416
USPC ..... 239/584, 539–540; 251/251, 252
See application file for complete search history.

(56) References Cited

U.S. PATENT DOCUMENTS 4,632,358 A * 12/1986 Orth ..... B60H 1/00485 251/117
4,674,537 A * 6/1987 Bergmann ..... F16K 3/085 137/625.31
5,011,112 A * 4/1991 Glamm ..... F16K 31/04 137/901
5,083,745 A * 1/1992 Tischer ..... F16K 31/04 251/129.05
5,417,083 A * 5/1995 Eber ..... F16K 3/085 251/129.11
2002/0158155 A1 10/2002 Mertzky ..... 239/585.1
2012/0048970 A1 3/2012 Choi ..... 239/581.1

FOREIGN PATENT DOCUMENTS

FR 2897396 A1 8/2007 ..... F02M 61/16
WO 01/44648 A2 6/2001 ..... F02M 51/06
WO 2014/154578 A1 10/2014 ..... F02M 61/18

OTHER PUBLICATIONS

International Search Report and Written Opinion, Application No. PCT/EP2014/055691, 8 pages, dated May 16, 2014.
Chinese Office Action, Application No. 201480011316.9, 14 pages, dated Feb. 28, 2017.

* cited by examiner

VALVE ASSEMBLY FOR A FLUID INJECTION VALVE AND FLUID INJECTION VALVE

CROSS-REFERENCE TO RELATED APPLICATIONS

This application is a U.S. National Stage application of International Application No. PCT/EP2014/055691 filed Mar. 21, 2014, which designates the United States of America, and claims priority to EP Application No. 13161691.4 filed Mar. 28, 2013, the contents of which are hereby incorporated by reference in their entirety.

TECHNICAL FIELD

Valve assembly for a fluid injection valve and fluid injection valve.

BACKGROUND

The present disclosure relates to a valve assembly for a fluid injection valve and to a fluid injection valve with a valve assembly.

Fluid injection valves are in widespread use for dosing fuel in internal combustion engines. In particular, the fluid injection valve is received in a combustion chamber of the internal combustion engine to dose fuel directly into the combustion chamber.

Such fluid injection valves are operated at high pressures of up to 300 bar in the case of gasoline engines and of more than 2000 bar in the case of diesel engines. Often, engines have different operation modes involving a variety of different fuel pressures.

SUMMARY

One embodiment provides a valve assembly for a fluid injection valve, the valve assembly having a longitudinal axis and comprising a valve seat, a valve disc and a valve stem, wherein the valve seat has an orifice, the orifice being laterally offset from the longitudinal axis, the valve disc has a fluid passage which, in a first angular position of the valve disc, is positioned in such fashion that it overlaps with the orifice at an interface of the valve disc and the valve seat to establish a fluid path through the valve disc and the valve seat for dispensing fluid from the valve assembly, the valve disc is rotatable around the longitudinal axis with respect to the valve seat from the first angular position to a second angular position, the valve seat and the valve disc mechanically interact to seal the orifice in the second angular position, the valve stem mechanically interacts with the valve disc to rotate the valve disc around the longitudinal axis, and the valve stem is axially movable with respect to the valve seat and rotationally fixed with respect to the valve seat and wherein the valve stem is mechanically coupled to the valve disc in such fashion that an axial movement of the valve stem is converted to a rotational movement of the valve disc.

In a further embodiment, the valve assembly further comprises a spring for pressing the valve disc against the valve seat.

In a further embodiment, the valve stem has a protrusion and the valve disc has a channel or vice versa, the protrusion engaging the channel and moving along the channel when the valve stem is moved in axial direction, wherein the channel is non-parallel to the longitudinal axis so that the valve stem and the valve disc mechanically interact by means of the protrusion and the channel for converting axial movement of the valve stem to rotational movement of the valve disc.

In a further embodiment, the valve assembly further comprises a valve body having a cavity extending from a fluid inlet end to a fluid outlet end, wherein the valve seat is arranged at the fluid outlet end and positionally and rotationally fixed with respect to the valve body, the longitudinal axis extends from the fluid inlet end to the fluid outlet end and the valve stem and the valve disc are arranged in the cavity.

Another embodiment provides a fluid injection valve comprising the valve assembly discussed above and an actuator assembly.

In a further embodiment, the actuator assembly is operable to displace the valve stem in axial direction for rotating the valve disc.

Another embodiment provides a fluid injection valve comprising a valve assembly and an actuator assembly, wherein the valve assembly has a longitudinal axis and comprises a valve seat and a valve disc, the valve seat has an orifice, the orifice being laterally offset from the longitudinal axis, the valve disc has a fluid passage which, in a first angular position of the valve disc, is positioned in such fashion that it overlaps with the orifice at an interface of the valve disc and the valve seat to establish a fluid path through the valve disc and the valve seat for dispensing fluid from the valve assembly, the valve disc is rotatable around the longitudinal axis with respect to the valve seat from the first angular position to a second angular position, the valve seat and the valve disc mechanically interact to seal the orifice in the second angular position, the valve assembly comprises a valve stem which mechanically interacts with the valve disc to rotate the valve disc around the longitudinal axis, the valve assembly comprises a valve body having a cavity extending from a fluid inlet end to a fluid outlet end, wherein the valve seat is arranged at the fluid outlet end and positionally and rotationally fixed with respect to the valve body, the longitudinal axis extends from the fluid inlet end to the fluid outlet end and the valve stem and the valve disc are arranged in the cavity, the actuator assembly comprises an armature, the armature being axially displaceable with respect to the valve body and rotationally fixed with respect to the valve body, the valve stem mechanically interacts with the valve disc in such fashion that a rotation of the valve stem around the longitudinal axis effects a rotation of the valve disc around the longitudinal axis, and the armature is mechanically coupled to the valve stem in such fashion that an axial movement of the armature is converted to a rotational movement of the valve stem and the valve disc.

In a further embodiment, the valve stem has a protrusion and the armature has a channel or vice versa, the protrusion engaging the channel and moving along the channel when the armature is moved in axial direction, wherein the channel is non-parallel to the longitudinal axis so that the valve stem and the armature mechanically interact by means of the protrusion and the channel for converting axial movement of the armature to rotational movement of the valve stem and the valve disc.

BRIEF DESCRIPTION OF THE DRAWINGS

Example embodiments are described below in association with schematic figures in which.

Figure 2:
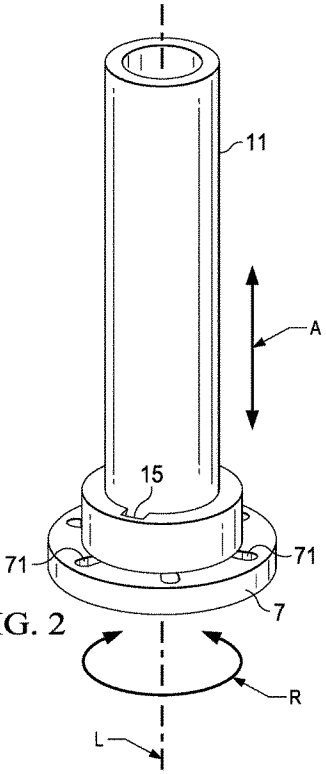
FIG. 2 shows a schematic perspective view of the valve stem and the valve disc of the valve assembly according to the first example embodiment.

In the example embodiments and figures, similar, identical or similarly acting elements are provided with the same reference symbols. The figures are not regarded to be true to scale. Rather, individual elements in the figures may be exaggerated in size for a better representability and/or for better understanding.

DETAILED DESCRIPTION

Embodiments of the present invention provide a valve assembly for a fluid injection valve which is particularly well suited for operation at high fluid pressures and/or for operating at a plurality of different fluid pressures.

According to one aspect, a valve assembly for a fluid injection valve is specified. A fluid injection valve comprising the valve assembly is specified according to another aspect.

The valve assembly has a longitudinal axis. It comprises a valve seat and a valve disc. The valve seat has an orifice which is laterally offset from longitudinal axis. In particular, the orifice does not overlap with the longitudinal axis in a top view along the longitudinal axis. The valve disc has a fluid passage. The fluid passage extends in particular completely through the valve disc in axial direction. While the description is made with reference to one orifice and one fluid passage, the valve assembly can also comprise a plurality of such orifices and fluid passages, wherein each fluid passage is in particular assigned to one of the orifices. The orifices and fluid passages may, for example, be evenly distributed around the longitudinal axis.

The valve disc is rotatable around the longitudinal axis between a first angular position and a second angular position. In the first angular position of the valve disc, the fluid passage is positioned in such fashion that it overlaps with the orifice at an interface of the valve disc and the valve seat to establish a fluid path through the valve disc and the valve disc for dispensing fluid from the valve assembly. In the second angular position, the valve seat and the valve disc mechanically interact to seal the orifice. In particular, the orifice and the fluid passage each have an aperture at the interface of the valve disc and the valve seat, the apertures being laterally displaced with respect to each other when the valve disc is in the second angular position so that they do not overlap in top view along the longitudinal axis.

With advantage, the pressure dependency of the force which is needed to rotate the valve disc for sealing and unsealing the orifice has no or only a particularly small dependence from the fluid pressure within the valve assembly. Therefore, the opening movement and the closing movement, i.e. the dynamic behavior of the valve assembly, has a particularly low pressure dependency—for example unlike inward opening needle valves which usually have a pressure imbalance that limits the maximum operating pressure beyond which the needle valve does not open and which leads to a change of the dynamic behavior of the needle valve with the pressure. Due to the small pressure dependency of the dynamic behavior of the present valve assembly, it can be advantageously controlled without electronic mapping of, for example, a fluid flow offset versus operating pressure. In addition, it is possible to manage so-called "overpressure modes" without additional devices or software features. A valve assembly according to the present disclosure is particularly well suited for operating at high operating pressures.

According to one embodiment, the axial position of the valve disc is fixed relative to the valve seat. For example, the valve assembly comprises a spring which is operable to press the valve disc against the valve seat. In this way, a particularly good sealing of the orifice is achievable.

In a further embodiment, the valve assembly comprises a valve stem which is operable to rotate the valve disc around the longitudinal axis, in particular from the first angular position to the second angular position and/or from the second angular position to the first angular position. In an embodiment, in which the valve stem is only operable to rotate the valve disc from the first to the second angular position or only from the second to the first angular position, but not in the respective opposite angular direction, the valve disc is preferably biased in the respective opposite angular direction, for example by means of an torsion spring. In one development, the spring for pressing the valve disc against the valve seat in axial direction also acts as the torsion spring for rotationally biasing the valve disc. A spring which is a helical spring is, for example, suitable in this case.

In one embodiment, the valve stem is axially moveable with respect to the valve seat and rotationally fixed with respect to the valve seat. In this embodiment, the valve stem is mechanically coupled to the valve disc in such fashion that an axial movement of the valve stem is converted to a rotational movement of the valve disc. For example, the valve stem has a protrusion and the valve disc has a channel or vice versa. The protrusion engages the channel and moves along the channel when the valve stem is moved in axial direction for rotating the valve disc. The channel is non-parallel, and in particular also non-perpendicular, to the longitudinal axis. For example it has the general shape of a portion of a helix extending around the longitudinal axis. The valve assembly with such a valve stem is particularly well suited for being actuated by a solenoid actuator assembly or a piezo-electric actuator assembly. In this way, a valve assembly is very well suited for use in internal combustion engines.

In one embodiment, the valve assembly further comprises a valve body. The valve body in particular has a cavity which extends from a fluid inlet end to a fluid outlet end. The valve seat is preferably arranged at the fluid outlet end. It is positionally and rotationally fixed with respect to the valve body. It may be formed in one piece with the valve body or the valve seat maybe a separate part which is assembled with the valve body, for example by welding, crimping and/or an interference fit. The longitudinal axis in particular extends from the fluid inlet end to the fluid outlet end of the valve body. The valve stem and the valve disc are preferably arranged in the cavity. A spring may also be arranged in the cavity and, for example, an end of the spring which is remote from the valve disc may bear on a shoulder of the valve body for compressing the spring.

The fluid injection valve may comprise an actuator assembly which is operable to move the valve stem for rotating the valve disc. The actuator assembly may, for example, be a solenoid actuator assembly or a piezo-electric actuator assembly.

In one embodiment, the actuator assembly is operable to displace the valve stem in axial direction for rotating the valve disc.

In another embodiment, the valve stem mechanically interacts with the valve disc in such fashion that a rotation of the valve stem around the longitudinal axis effects a rotation of the valve disc around the longitudinal axis. For example, the valve stem and the valve disc are rigidly fixed to each other. For example in this case, the actuator assembly may comprise an armature, the armature being axially displaceable with respect to the valve body and rotationally fixed with respect to the valve body. The armature is preferably mechanically coupled to the valve stem in such fashion that an axial movement of the armature is converted to a rotational movement of the valve stem and the valve disc. With advantage, conversion between axial and rotational movement may be particularly reliable in this case. Bearing of the valve stem may be particularly simple.

Figure 1:
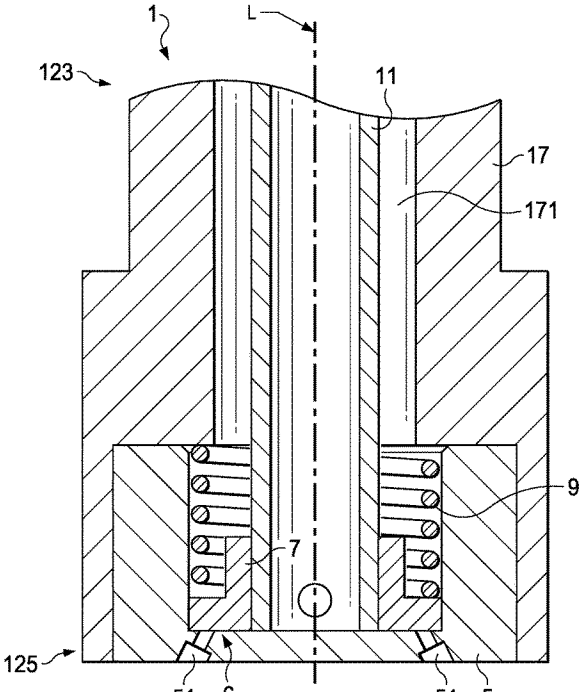
FIG. 1 shows a schematic sectional view of a valve assembly according to a first example embodiment.

In one development, the valve stem has a protrusion and the armature has a channel or vice versa. The protrusion engages the channel and moves along the channel when the armature is moved in axial direction. The channel is non-parallel, and in particular also non-perpendicular, to the longitudinal axis. For example it has the general shape of a portion of a helix extending around the longitudinal axis. In this way, the valve stem and the armature mechanically interact by means of the protrusion and the channel for converting axial movement of the armature to rotational movement of the valve stem and the valve disc.

exampleexampleexampleexampleexampleexampleex-ampleexampleexamplee xampleexampleexample FIG. 1 shows a cross-sectional view of a valve assembly 1 according to a first example embodiment of the invention.

Figure 7:
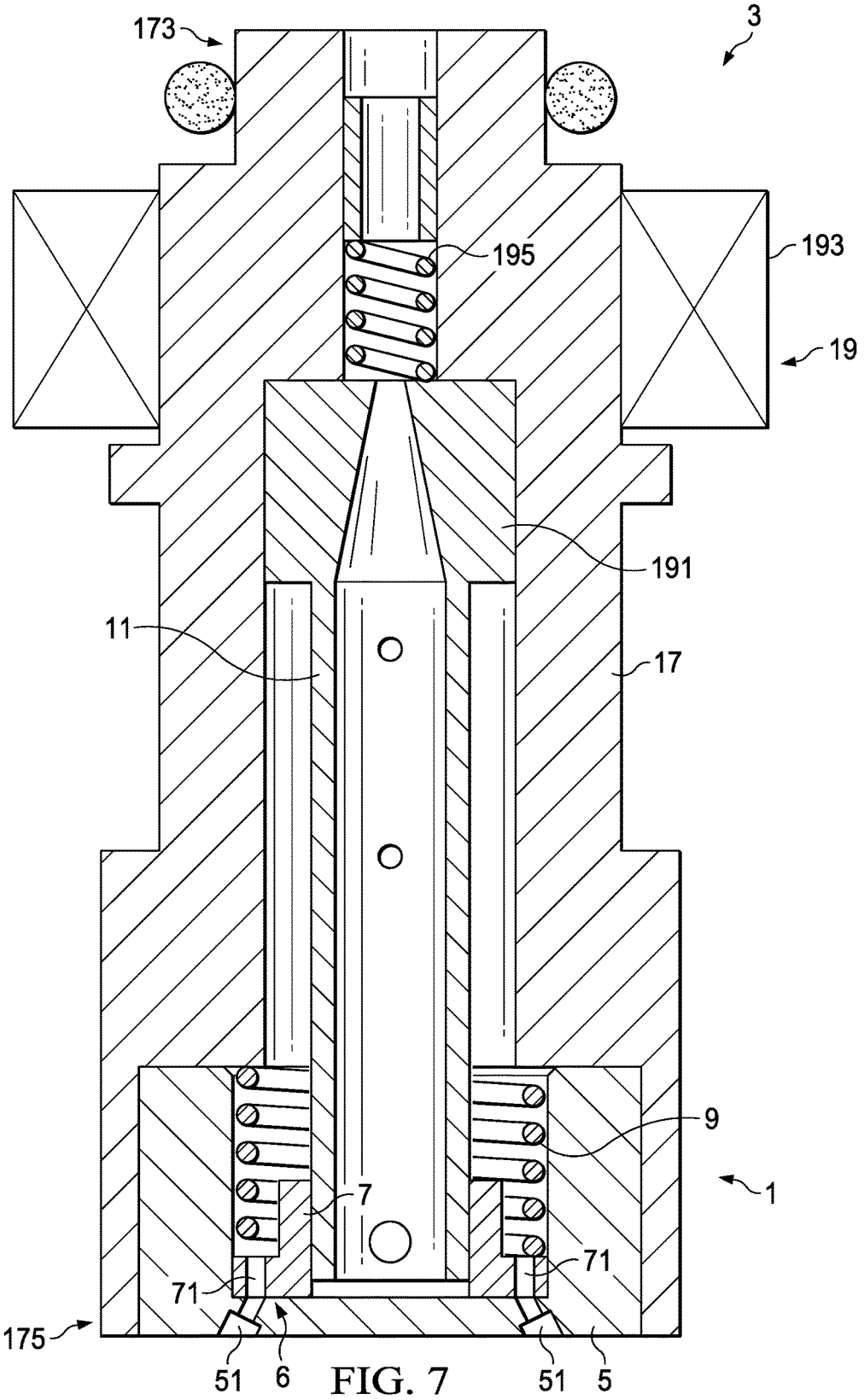
FIG. 7 shows a schematic sectional view of a fluid injection valve with a valve assembly according to the first example embodiment.

FIG. 7 shows a schematic cross-section of a fluid injection valve 3 comprising the valve assembly 1 of FIG. 1.

The valve assembly 1 has a longitudinal axis L. It comprises a valve seat 5 and a valve disc 7. The valve disc 7 is arranged adjacent to the valve seat 5 so that the valve disc 7 and the valve seat 5 have a common interface 6. Further, the valve assembly 1 comprises a valve stem 11.

Figure 3:
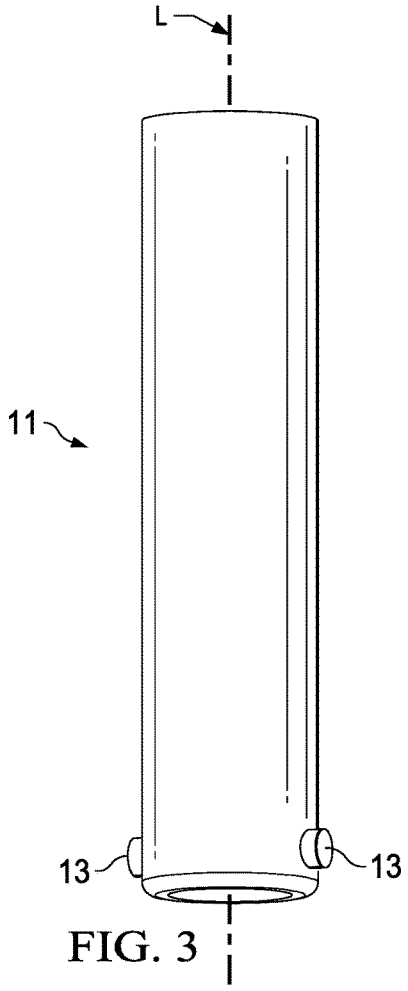
FIG. 3 shows a schematic perspective view of a valve stem of the valve assembly according to the first example embodiment.
Figure 4:
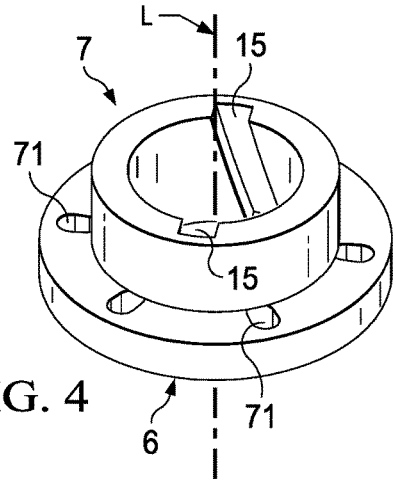
FIG. 4 shows a schematic perspective view of the valve disc of the valve assembly according to the first example embodiment.
Figure 5:
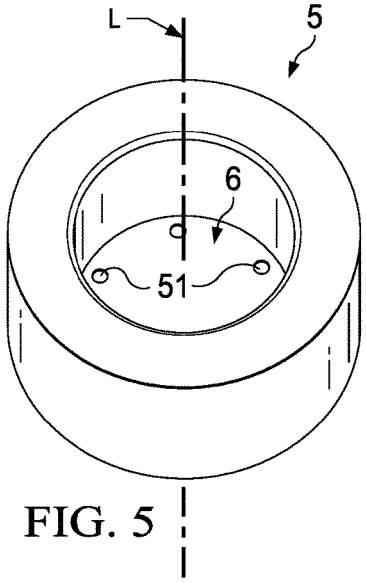
FIG. 5 shows a schematic perspective view of the valve seat of the valve assembly according to the first example embodiment.

FIG. 2 shows a perspective view of the valve disc 7 and the valve stem 11. FIG. 3 shows another perspective view of the valve stem 11. FIG. 4 shows another perspective view of the valve disc 7. FIG. 5 shows a perspective view of the valve seat 5.

The valve seat 5 has a plurality of orifices 51 which a laterally offset from the longitudinal axis L. In the present embodiment, the orifices 51 are arranged in an imaginary region having a cylinder ring shape having the longitudinal axis L as its center axis. For example, the orifices 51 are uniformly distributed around the longitudinal axis L, i.e. the angle which is defined by the centers of gravity of two adjacent orifices 51 and the longitudinal axis L as its vertex in top view along the longitudinal axis L is identical for all pairs of adjacent orifices 51.

The orifices 51 may be of various shapes. In the present embodiment, the orifices 51 extend obliquely through the valve seat 5 with respect to the longitudinal axis L. They are shaped as stepped trough-holes the cross section of which is larger at a side of the orifices 51 facing a fluid outlet end 175 of the valve assembly 1 and then at the end facing a fluid inlet end 173 of the valve assembly 1.

The valve disc 7 has a plurality of fluid passages 71. Preferably, number of fluid passages 71 equals the number of orifices 51. In a first angular position P1, the valve disc 7 is positioned in such fashion that each of the fluid passages 71 overlaps exactly one of the orifices 51 in the interface region 6 of the valve disc 7 and the valve seat 5. In this way, a fluid path is established through the valve disc 7 and the valve seat 5 for dispensing fluid from the valve assembly 1.

The valve disc 7 is rotatable around the longitudinal axis L from the first angular position P1 to a second angular position P2.

Figure 6A:
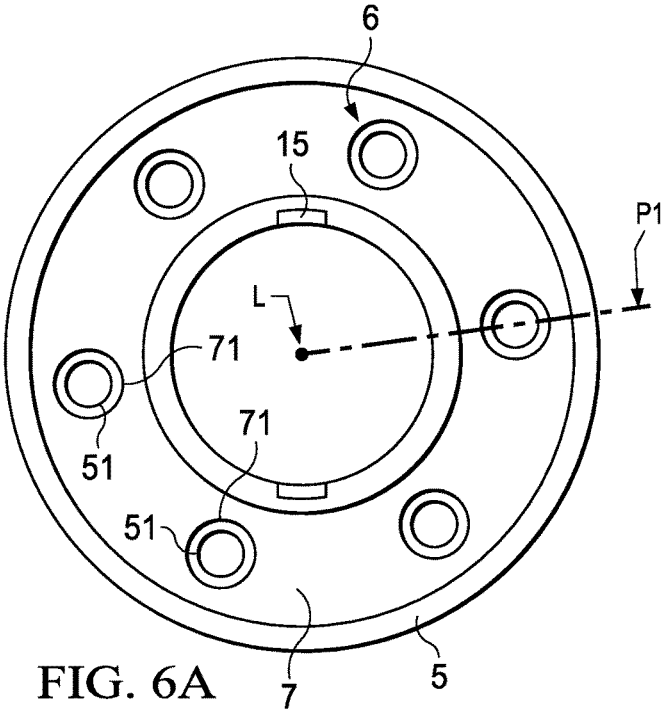
FIG. 6A shows a schematic top view of the valve disc and the valve seat of the valve assembly according to the first example embodiment in a first angular position.
Figure 6B:
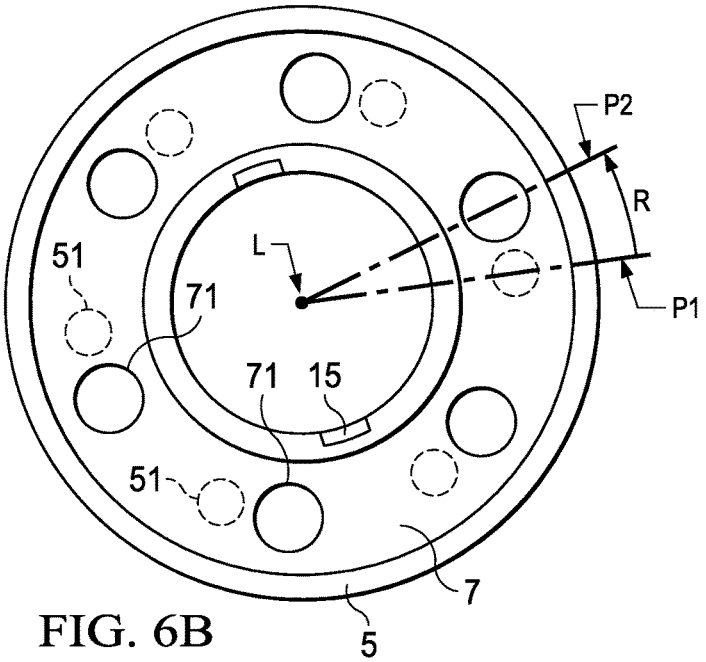
FIG. 6B shows a schematic top view of the valve disc and the valve seat of the valve assembly according to the first example embodiment in a second angular position.

FIG. 6A shows a top view along the longitudinal axis L of the valve seat 5 and the valve disc 7, the valve disc 7 being positioned in the first angular position P1. FIG. 6B shows a top view of the valve seat 5 and the valve disc 7 along the longitudinal axis L with the valve disc 7 being positioned in the second angular position P2. In addition, FIG. 1 also shows the valve assembly with the valve disc being positioned in the second angular position P2 and FIG. 7 shows the valve assembly 1 with the valve disc 7 being positioned in the first angular position P1.

Apertures of the orifices 51 which are positioned at the interface 6 of the valve seat 5 with the valve disc 7 completely overlap with apertures of the fluid passages 71 of the valve disc 7 when the valve disc 7 is in the first angular position P1. In the present embodiment, the fluid passages 71 extend trough the valve disc 7 parallel to the direction of the longitudinal axis L, so that the apertures of the orifices 51 which are positioned at the interface 6 of the valve disc 7 with the valve seat 5 are arranged completely within the fluid passages 71 in top view along the longitudinal axis L when the valve disc 7 is in the first angular position P1.

A rotational movement R of the valve disc 7 with respect to the valve seat 5 from the first angular position P1 to the second angular position P2 results in a lateral displacement of each of the fluid passages 71 away from the respectively assigned orifice 51. When the valve disc 7 is in the second angular position P2, the fluid passages 71 are laterally spaced apart from the apertures of the orifices 51 at the interface 6. In this way, the valve seat 5 and the valve disc 7 mechanically interact to seal the orifices 51 for preventing fluid flow from the valve assembly 1 when the valve disc 7 is in the second angular position P2.

In this way, the valve disc 7 cooperates with the valve seat 5 for sealing and unsealing the orifices 51. The second angular position P2 corresponds to a closing position in which the valve disc 7 is operable to prevent fluid flow through the orifices 51. The first angular position P1 corresponds to an opened configuration in which the valve assembly 1 is operable to dispense fluid through the orifices 51.

In the present context, the interface 6 of the valve seat 5 with the valve disc 7 is defined by a sealing surface of the valve seat 5 which comprises the apertures of the orifices 51 which face the valve disc 7 and by a sealing surface of the valve disc 7 which comprises apertures of the fluid passages 71 which face the valve seat 5. The sealing surfaces of the valve seat 5 and the valve disc 7 may, for example, be in direct contact with each other. The sealing surface of the valve disc 7 preferably faces towards the fluid outlet end 175 and the sealing surface of the valve seat 5 preferably faces towards the fluid inlet end 173.

In the present embodiment, the valve assembly comprises a spring 9 which is operable to press the valve disc 7 against the valve seat 5 for pressing the sealing surface of the valve disc 7 against the sealing surface of the valve seat 5. The spring retains the valve disc 7 in an axially fixed position with respect to the valve seat 5 during operation of the valve assembly 1.

In order to limit or to prevent linear movement of the valve disc 7 with respect to the valve seat 5 in directions perpendicular to the longitudinal axis L, the valve disc 7 is arranged in a recess of the valve seat 5.

In the present embodiment, the valve assembly 1 comprises a valve body 17 which has a cavity 171 in which the valve disc 7 is arranged. The valve body 17 and its cavity 171 extend from the fluid inlet end 173 to the fluid outlet end 175. The valve seat 5 is received in the cavity 171 at the fluid outlet end 175. It is rigidly fixed with the valve body 17. In this way, it is neither rotatable nor axially moveable with respect to the valve body 17 during operation of the valve assembly 1. The valve seat 5 may be fixed to the valve body 17 for example by means of at least one of welding, friction fit or crimping. An end of the spring 9 which is remote from the valve disc 7 bears on a shoulder of the valve body 17 which is positioned in such fashion that the spring 9 is pre-compressed when the valve seat 5 and the valve disc 7 are mounted into the valve body 17 during the manufacture of the valve assembly 17.

In the present embodiment, the valve assembly 1 further comprises a valve stem 11 which mechanically interacts with the valve disc 7 to rotate the valve disc 7 around the longitudinal axis L.

Specifically the valve stem 11 in the present embodiment is axially moveable with respect to the valve seat 5 and the valve body 17 and rotationally fixed with respect to the valve seat 5 and the valve body 17. For example, the valve body 17 comprises guide elements which allow axial displacement of the valve stem 11 and block rotational movement of the valve stem 11 with respect to valve body 17, in particular by means of mechanical interaction with the valve stem 11.

The valve stem 11 is mechanically coupled to the valve disc 7 in such fashion that an axial movement A of the valve stem 11 is converted to a rotational movement R of the valve disc 7. In the present embodiment, this mechanical coupling is effected by means of a pair of protrusions 13 which are arranged at an outer circumferential surface of the valve stem 11 and a pair of channels in an inner circumferential surface of the valve disc 7. Specifically, the inner circumferential surface may define a central opening of the valve disc 7 which extends, in longitudinal direction L, into the valve disc 7 or completely through the valve disc 7. The valve stem 11 may be received in the central opening of the valve disc 7. The protrusions are in the form of pins or noses in the present embodiment. The channels 15 are non-parallel to the longitudinal axis L and have the shape of a section of the helix which has the longitudinal axis L as central axis.

The protrusions 13 are positioned at the valve stem 11 in such fashion that each of the protrusions 13 engages one of the channels 15 and moves along the respective channel 15 when the valve stem 11 is moved in axial direction. In this way, axial movement A of the valve stem 11 causes the protrusions 13 to press against a sidewall of the respective channel 15. Since the valve stem 11—and with it the protrusions 13—is rotationally fix, since the channels 15 extend non-parallel to the longitudinal axis L and since the valve disc 7 is only rotatable but not axially moveable with respect to the longitudinal axis L, interaction of the protrusions 13 of the channels 15 effects a torque on the valve disc 7 which results in a rotational movement R of the valve disc 7. Shapes and positions of the protrusions 13 and the channels 15 are expediently selected in such fashion that the valve disc 7 is displaceable in angular direction from the first angular position P1 to the second angular position P2 and back by means of an axial movement of the valve stem 11.

The fluid valve 3 additionally comprises an actuator assembly 19. The actuator assembly 19 is operable to displace the valve stem 11 in axial direction for rotating the valve disc 7. In the present embodiment, the actuator assembly 19 is an electromagnetic actuator assembly comprising an armature 191 which is arranged in the cavity 171 and axially moveable with respect to the valve body 17. The armature 191 is mechanically coupled to the valve stem 11 in such fashion that it takes the valve stem 11 with it in axial direction when it is displaced axially. In the present embodiment the armature 191 is rigidly coupled to the valve stem 11. For example, the armature 191 and the valve stem 11 are in one piece.

The coil 193, the valve body 17, and the armature 191 from an electromagnetic circuit so that the coil 193 is operable to move the armature in a direction away from the valve seat 5 when the coil 193 is energized. The return spring 195 of the actuator assembly 19 biases the armature 191 towards the valve seat 5, so that the armature 195 is moved towards the valve seat 5 when the coil 193 is de-energized. Alternatively, a piezo-electric actuator assembly 19 can be provided for in the fluid injection valve 3. Such actuator assemblies 19 are known, in principle, to the skilled person therefore are not explained in greater detail here.

Expediently, the valve stem 11 may have an elongated shape, i.e. its extension along the longitudinal axis L is larger—in particular at least twice as large, preferably at least five times as large—as its extension perpendicular to the longitudinal axis L. The valve stem 11 preferably extends in axial direction L from the valve disc 7 to the armature 191.

The valve stem 11 of the present embodiment has the general shape of a hollow cylinder. It may have a sidewall which is perforated so that fluid may flow from the interior of the hollow cylinder to the exterior. For example, fluid may flow from the fluid inlet end 173 of the valve assembly 1 into the interior of the valve stem 11, further through its perforated sidewall, through the fluid passages 71, and through the orifices 51 to be dispensed at the fluid outlet end 175.

Figure 8A:
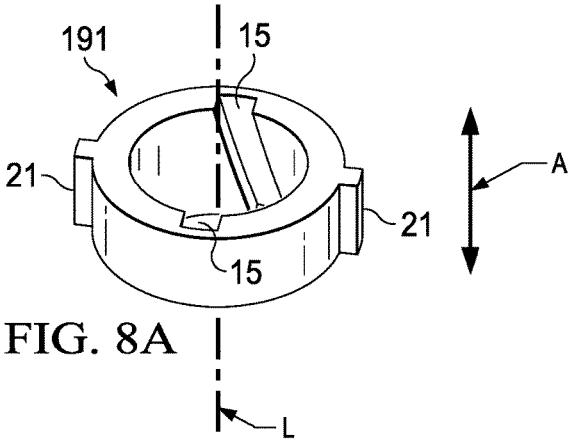
FIG. 8A shows a schematic perspective view of the armature of a valve assembly according to a second example embodiment.

FIG. 8A shows the armature 191 of a valve assembly 1 according to a second example embodiment in a schematic perspective view.

Figure 8B:
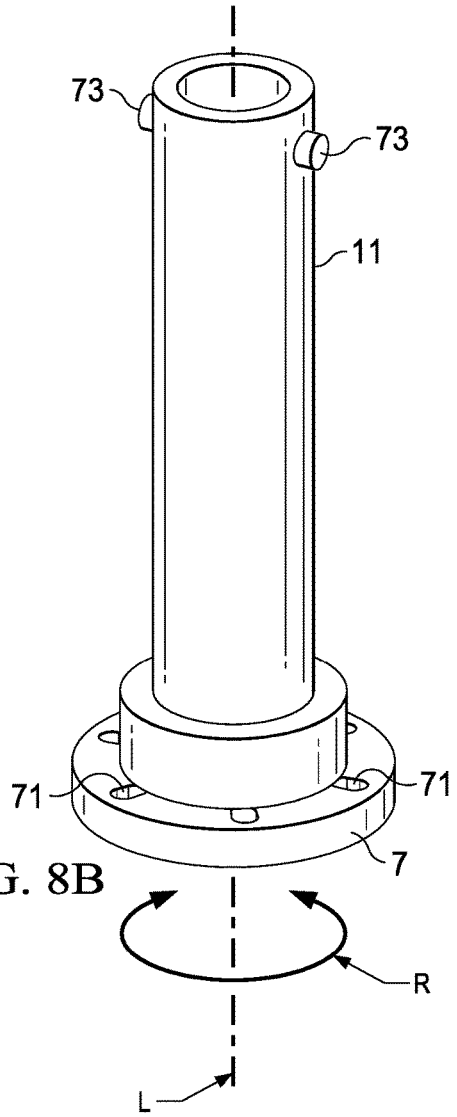
FIG. 8B shows a schematic perspective view of the valve stem and the valve disc of the valve assembly according to the second example embodiment.

FIG. 8B shows the valve stem 11 and the valve disc 7 of the valve assembly 1 according to the second example embodiment in a schematic perspective view.

The valve assembly 1 according to the second example embodiment corresponds in general with the valve assembly 1 according to the first example embodiment.

In contrast to the valve assembly 1 of the first example embodiment, the valve stem 11 of the valve assembly 1 of the present embodiment is rigidly fixed with the valve disc 7 so that the valve stem 11 and the valve disc 7 are neither axially nor rotationally displaceable with respect to each other. Thus, when the valve stem 11 is rotated around the longitudinal axis L, it interacts with the valve disc 7 so that also the valve disc 7 is rotated around the longitudinal axis L.

In the present embodiment, the armature 191 is axially moveable with respect to the valve stem 11. The armature 191 is also axially displaceable with respect to the valve body 17, as in the first example embodiment. In one development, the valve body 17 comprises a hard stop (not shown in the figures) which is operable to limit axial displacement of the armature 191 with respect to the valve body 17 in the direction towards the fluid outlet end 175.

Expediently, the armature 191 is rotationally fixed with respect to the valve body 17. In other words, the armature 191 mechanically interacts with the valve body 17 to block rotational movement of the armature 191 with respect to the valve body 17, for example by means of at least one guide element 21 of the armature 191 and a corresponding guide element of the valve body 17 (not shown in the figures). The guide element 21 may be, for example, an axially extending bar as in FIG. 8A, an axially extending groove, a flat side face or the like. Such guide elements can also be used for blocking rotational movement of the valve stem 11 and/or the armature 191 with respect to the valve body 17 in the first example embodiment and other embodiments of the valve assembly 1.

The armature 191 and the valve stem 11 are mechanically coupled in such fashion that axial movement A of the armature 191 is converted into rotational movement R of the valve stem 11 and—since the valve stem 11 is fixed to the valve disc 7—of the valve disc 7. The mechanical coupling may be effected in analogous fashion to the mechanical coupling of the valve stem 11 and the valve disc 7 in the first example embodiment.

Specifically, the valve stem 11 may be received in a central opening of the armature 191. The valve stem may have a plurality of protrusions 13 at its outer circumferential surface and an inner circumferential surface of the armature 191 which defines the central opening may have corresponding channels 15. The protrusions 13 are positioned at the valve stem 11 in such fashion that each of the protrusions 13 engages one of the channels 15 and moves along the respective channel 15 when the armature 191 is moved in axial direction. In this way, axial movement A of the armature 191 causes a sidewall of the respective channel 15 to press against the respective protrusion 14. Since the armature 191—and with it the channel 15—is rotationally fix, since the channels 15 extend non-parallel to the longitudinal axis L and since the valve stem 11 and the valve disc 7 are only rotatable but not axially moveable with respect to the valve body 17, interaction of the protrusions 13 of the channels 15 effects a torque on the valve stem 11 which results in a rotational movement R of the valve stem 11 and the valve disc 7.

The invention is not limited to specific embodiments by the description on basis on these example embodiments. Rather, it comprises any combination of elements of different embodiments. Moreover, the invention comprises any combination of claims and any combination of features disclosed by the claims.

What is claimed is:

1. A fuel injection valve, comprising:

a valve assembly having a longitudinal axis and comprising a valve seat extending transverse the longitudinal axis, a valve disc extending transverse the longitudinal axis, and a valve stem extending along the longitudinal axis, wherein:

the valve seat comprises an orifice laterally offset from the longitudinal axis, the valve disc comprises a fluid passage which, in a first angular position of the valve disc, overlaps the orifice at an interface of the valve disc and the valve seat to establish a fluid path through the valve disc and the valve seat, the fluid path extending through the valve disc parallel to the longitudinal axis for dispensing fluid from the valve assembly, the valve disc rotates around the longitudinal axis from the first angular position to a second angular position, the valve seat and the valve disc mechanically interact to seal the orifice in the second angular position, a spring directly pressing the valve disc against the valve seat, the valve stem mechanically interacts with the valve disc to rotate the valve disc around the longitudinal axis, the valve stem moves along the longitudinal axis with respect to the valve seat and is rotationally fixed with respect to the valve seat, and the valve stem is mechanically coupled to the valve disc such that an axial movement of the valve stem is converted to a rotational movement of the valve disc, and an actuator assembly configured to move the valve stem axially to thereby rotate the valve disc.

2. The fuel injection valve of claim 1, wherein the actuator assembly is operable to displace the valve stem axially to thereby rotate the valve disc.

3. The fuel injection valve of claim 1, wherein the valve assembly further comprises a valve body having a cavity extending from a fluid inlet end to a fluid outlet end, wherein the valve seat is arranged at the fluid outlet end and positionally and rotationally fixed with respect to the valve body, wherein the longitudinal axis extends from the fluid inlet end to the fluid outlet end, and the valve stem and the valve disc are arranged in the cavity.

* * * * *